US011261710B2

(12) United States Patent
Al Mulhem

(10) Patent No.: US 11,261,710 B2
(45) Date of Patent: Mar. 1, 2022

(54) WELL PERFORATING USING ELECTRICAL DISCHARGE MACHINING

(71) Applicant: Saudi Arabian Oil Company, Dhahran (SA)

(72) Inventor: Abdulrahman Abdulaziz Al Mulhem, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 11 days.

(21) Appl. No.: 16/800,312

(22) Filed: Feb. 25, 2020

(65) Prior Publication Data

US 2021/0262324 A1 Aug. 26, 2021

(51) Int. Cl.

| | |
|---|---|
| ***E21B 43/112*** | (2006.01) |
| ***E21B 17/10*** | (2006.01) |
| ***E21B 23/01*** | (2006.01) |
| ***E21B 43/11*** | (2006.01) |
| *E21B 43/119* | (2006.01) |
| *E21B 47/09* | (2012.01) |

(52) U.S. Cl.

CPC ..... *E21B 43/112* (2013.01); *E21B 17/1021* (2013.01); *E21B 23/01* (2013.01); *E21B 43/11* (2013.01); *E21B 43/119* (2013.01); *E21B 47/09* (2013.01)

(58) Field of Classification Search

CPC ..... E21B 43/11; E21B 43/112; E21B 43/119; E21B 23/01; E21B 17/1021

See application file for complete search history.

(56) References Cited

U.S. PATENT DOCUMENTS

| | | | | |
|---|---|---|---|---|
| 2,263,412 A * | 11/1941 | Armentreut | ..... | E21B 43/112 166/297 |
| 3,017,486 A | 1/1962 | Kogan et al. | | |
| 3,461,964 A | 8/1969 | Venghiattis | | |
| 3,465,836 A * | 9/1969 | Fields | ..... | E21B 43/119 175/4.51 |
| 4,282,940 A | 8/1981 | Salisbury et al. | | |

(Continued)

FOREIGN PATENT DOCUMENTS

| | | |
|---|---|---|
| CN | 106 761 646 A | 5/2017 |
| WO | WO-2002/25050 A2 | 3/2002 |
| WO | WO-2012/064330 A1 | 5/2012 |

OTHER PUBLICATIONS

Badeghaish, W. et al., Comprehensive Review of Well Tractor Technology in Highly Extended Reach Wells, Presented at the SPE/ICoTA Coiled Tubing & Well Intervention Conference & Exhibition, 22 pages (Mar. 2018), <https://www.onepetro.org/conference-paper/SPE-189906-MS>. Retrieved on Aug. 10, 2020.

(Continued)

*Primary Examiner* — D. Andrews

(74) *Attorney, Agent, or Firm* — Choate, Hall & Stewart LLP; Charles E. Lyon; Peter A. Flynn

(57) ABSTRACT

A perforation system includes: a perforating tool including a main body and a perforating head disposed within the main body; a wireline electrically coupled to the perforating head; a pulse generator electrically coupled to the wireline; and a power supply electrically coupled to the pulse generator. Upon electrification of the perforating head, a spark discharged from the perforating head arcs to a perforation target location.

19 Claims, 5 Drawing Sheets

(56) References Cited

U.S. PATENT DOCUMENTS

| | | | | |
|---|---|---|---|---|
| 4,793,417 | A | 12/1988 | Rumbaugh | |
| 6,439,313 | B1 * | 8/2002 | Thomeer | E21B 23/02 166/361 |
| 6,680,454 | B1 | 1/2004 | Batzinger et al. | |
| 7,195,066 | B2 | 3/2007 | Sukup et al. | |
| 7,487,834 | B2 | 2/2009 | Reed et al. | |
| 7,565,927 | B2 * | 7/2009 | Gerez | E21B 43/116 166/250.01 |
| 8,489,374 | B2 | 7/2013 | Dogru | |
| 2004/0206505 | A1 | 10/2004 | Batarseh | |
| 2005/0045331 | A1 * | 3/2005 | Lerche | E21B 43/119 166/297 |
| 2006/0102343 | A1 | 5/2006 | Skinner et al. | |
| 2009/0223659 | A1 | 9/2009 | Hill et al. | |
| 2013/0068461 | A1 | 3/2013 | Maerz et al. | |
| 2013/0213639 | A1 * | 8/2013 | Bittar | E21B 17/00 166/248 |
| 2014/0184364 | A1 | 7/2014 | McMillon et al. | |
| 2019/0011422 | A1 | 1/2019 | McGregor et al. | |
| 2019/0055838 | A1 | 2/2019 | Hou et al. | |

OTHER PUBLICATIONS

International Search Report for PCT/IB2020/053556, 5 pages (dated Sep. 1, 2020).
Written Opinion for PCT/IB2020/053556, 9 pages (dated Sep. 1, 2020).

* cited by examiner

WELL PERFORATING USING ELECTRICAL DISCHARGE MACHINING

FIELD

The subject matter described herein relates to apparatuses, methods and systems for making perforations in oil and gas wells.

BACKGROUND

The practice of well perforation in the oil and gas industry is currently carried out by shaped exploding charges commonly known as perforating guns. Perforating guns have been used for many years, and are widespread across the industry. However, perforating guns present safety and public security issues. Perforating guns utilize explosives which are dangerous and cause safety concerns to oil field personnel, and also may cause public security concerns. It is not uncommon for police officers or other security officers to escort perforating guns while they are being transported and used, in order to ensure that the charges are discharged within wells, and are not used for any other purposes. As such, it is not uncommon for worksites to experience delays when security and law enforcement officers are not available. Site production engineers and operators engineers often express concerns about the safety of using and transporting perforating guns. Government security personnel are often required in certain jurisdictions to escort perforating guns, and to oversee the process of perforating in the oil and gas industry, to ensure charges are consumed, thereby adding to the costs and potential delays associated with the use of perforating guns.

SUMMARY

The present disclosed embodiments include apparatuses, systems, and methods for making perforations using a wireline or coil tubing to deploy a perforating tool that contains an electrical discharge machining (EDM) system to perforate casings in oil and gas wells or boreholes.

Electrical discharge machining (EDM) is an electrical process where an electrical discharge (that is, a spark) is created between two electrodes. The two electrodes are separated by a dielectric fluid and when a voltage across the electrodes is increased, an electrical discharge (that is, a spark) occurs due to the breakdown of the dielectric medium. The spark heats the electrodes and causes spallation of a work piece or surface located in the vicinity of the electrodes, thus creating a gauged hole therein. This technique is the basis of the present disclosed embodiments.

In one aspect, the present invention is directed to a perforation system including: a perforating tool including a main body and a perforating head disposed within the main body; a wireline electrically coupled to the perforating head; a pulse generator electrically coupled to the wireline; and a power supply electrically coupled to the pulse generator. Upon electrification of the perforating head, a spark discharged from the perforating head arcs to a perforation target location.

In some embodiments, the perforating tool is deployed within a downhole environment.

In some embodiments, the downhole environment includes a borehole, and the pulse generator is disposed at a surface of the borehole.

In some embodiments, the perforation target location is disposed on or within a casing disposed within the borehole.

In some embodiments, the system includes at least one set of anchoring arms longitudinally disposed along an outer surface of the main body.

In some embodiments, the set of anchoring arms independently expands and retracts radially outward and inward to position and anchor the main body proximate to the casing within which the perforation target is disposed.

In some embodiments, the electrification occurs at a voltage in a range from about 30 volts to about 600 volts.

In some embodiments, the electrification occurs at an operating frequency from about 200 kHz to about 15 MHz.

In some embodiments, the system includes a dielectric fluid disposed between the perforating head and the perforation target location, the dielectric fluid including water, purified water, salt water, mineral oil (such as transformer oil), hydrochloric acid, oil, diesel, crude oil, and/or hydrofluoric acid.

In some embodiments, the system includes a voltage multiplier disposed in the main body and/or the pulse generator.

In some embodiments, the system includes a hydraulic piston disposed within the main body, where the hydraulic piston pushes the perforating head radially outward as the perforation target location begins to spall.

In some embodiments, a duration of each pulse transmitted by the pulse generator to the perforating head is from about 1 millisecond (ms) to about 3000 ms.

In some embodiments, the system includes a dielectric fluid disposed between the perforating head and the perforation target location, the dielectric fluid including water, purified water, salt water, mineral oil (such as transformer oil), hydrochloric acid, oil, diesel, crude oil, and/or hydrofluoric acid. The electrification occurs at a voltage in a range from about 30 volts to about 600 volts, and the electrification occurs at an operating frequency from about 200 kHz to about 15 MHz.

In another aspect, the present invention is directed to a perforation tool including: a main body including a generally cylindrical shape; a perforating head disposed within the main body proximate a bottom end of the main body, the perforating head including at least one electrode; a wireline electrically coupled to the perforating head, the wireline coupled to a top end of the main body; and two or more sets of anchoring arms, each set of the two or more sets of anchoring arms longitudinally disposed along an outer surface of the main body. Each of the two or more sets of anchoring arms may selectively expand and retract radially outward and inward to position and anchor the main body proximate a perforation target location.

In some embodiments, the tool includes at least one sensor disposed on or within the main body, the sensor including a longitudinal vertical displacement transducer (LVDT), a casing collar locator (CCL), a proximity probe, and/or a gyroscope.

In some embodiments, the tool includes a longitudinal vertical displacement transducer (LVDT), a casing collar locator (CCL), a proximity probe, and a gyroscope.

In some embodiments, each set of anchoring arms includes a first arm and a second arm, where each of the first arm and second arm are coupled together at a first end, and where each of the first arm and second are arm are coupled to the main body at a second end.

In another aspect, the present invention is directed to a method of perforating a well including: disposing a perforating tool downhole, the perforating tool including: a main body, a perforating head disposed within the main body, and at least one electrode disposed within the perforating head;

locating the perforating tool proximate a perforation target location disposed within the well; and electrifying the electrode such that at least one spark arcs from the perforating head to the perforation target location.

In some embodiments, the method includes radially expanding at least one set of anchoring arms after locating the perforating tool such that the set of anchoring arms engages a casing of the well.

In some embodiments, the set of anchoring arms engages a perforating platform disposed within the well, the perforating platform including a planar surface that is oriented perpendicular to a centerline of the well.

In some embodiments, locating the perforating tool further includes circumferentially aligning the perforating head with the perforating target location.

In some embodiments, the method includes: removing electrification from the perforating head; and assessing the status of the perforation target location.

It should be understood that the order of steps or order for performing certain action is immaterial as long as the invention remains operable. Moreover, two or more steps or actions may be conducted simultaneously.

The following description is for illustration and exemplification of the disclosure only, and is not intended to limit the invention to the specific embodiments described.

The mention herein of any publication, for example, in the Background section, is not an admission that the publication serves as prior art with respect to any of the present claims. The Background section is presented for purposes of clarity and is not meant as a description of prior art with respect to any claim.

BRIEF DESCRIPTION OF THE DRAWINGS

A full and enabling disclosure of the present disclosed embodiments, including the best mode thereof, directed to one of ordinary skill in the art, is set forth in the specification, which makes reference to the appended figures, in which.

DESCRIPTION OF CERTAIN EMBODIMENTS OF THE INVENTION

Figure 1:
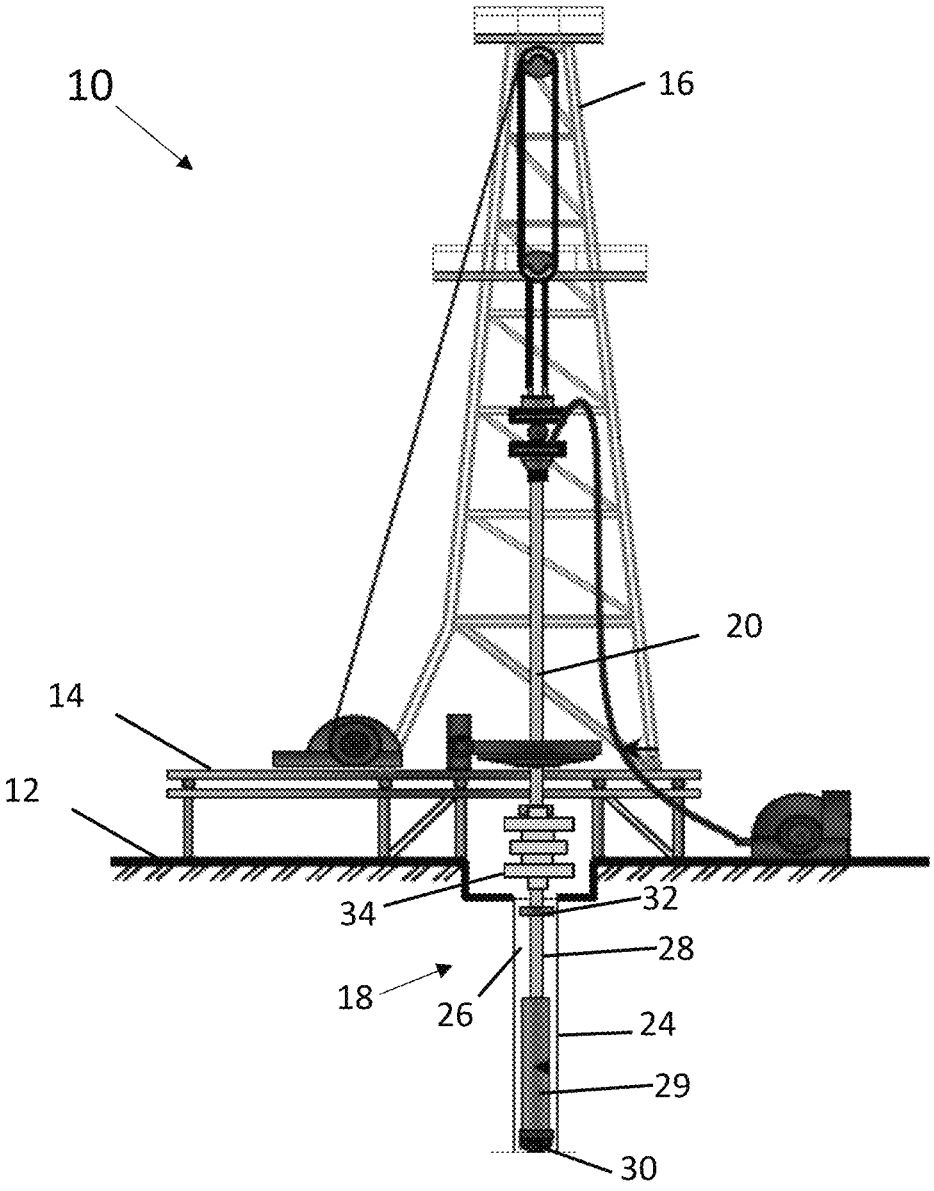
FIG. 1 illustrates a side view of an exemplary oil rig.

Reference will now be made in detail to the present disclosed embodiments, one or more examples of which are illustrated in the accompanying drawings. The detailed description uses numerical and/or letter designations to refer to features in the drawings. Like or similar designations in the drawings and description have been used to refer to like or similar parts of the present embodiments.

The present disclosed embodiments include apparatuses, methods and systems that utilize electrical discharge machining (EDM). EDM is a manufacturing process where conductive media (for example, metallic elements) are shaped using high temperature plasmas that result from electrical discharges between two conductive media, separated by a dielectric medium. The high temperature plasma removes material from a work piece (that is, the part, component or surface being machined) by a series of rapidly recurring current discharges between the two conductive electrodes (that is, the media), separated by the dielectric medium. When the voltage between the two electrodes or conductive media is increased, the intensity of the electric field in the volume between them becomes greater than the strength of the dielectric medium causing it to break down, allowing electric current to flow between the two conductive media in the form of a very high temperature plasma. The result is material being removed by spallation from the adjacent work piece. The resulting debris can be removed from the work piece by continuous flushing of a dielectric medium such as mineral oil (and other dielectric fluid discussed below). The electrical current causing this discharge process is repeated causing more removal of material from the work piece. In some embodiments, a work piece (for example, a grounded surface) may take the place of one of the electrodes.

FIG. 1 illustrates an exemplary oil rig 10, including a rig floor 14, elevated above the ground 12. Extending vertically upward from the rig floor 14 is a derrick 16 which includes a framework for supporting the oil rig 10. The oil rig 10 may include a drill pipe 20 that may be coupled via various components to a drilling string 28. The drilling string 28 may be disposed in a borehole 18 that includes a casing 24 disposed therewithin. The borehole 18 may include an annulus 26 defined by the ring-shaped space disposed radially outward of the drilling string 28 (and radially inward of the casing 24). The drilling string 28 may include one or more drill collars 29, as well as one or more drill bits 30 disposed at the bottom of the drilling string 28. The oil rig 10 may also include a managed pressure drilling (MPD) system 32 including one or more rotating control devices (RCD) for maintaining the pressure within the borehole 18 while one or more pieces of equipment is rotating or operating. The oil rig may also include a blow-out preventer (BOP) 34 for preventing blowouts or uncontrolled releases of hydrocarbons at the oil rig 10.

Figure 2:
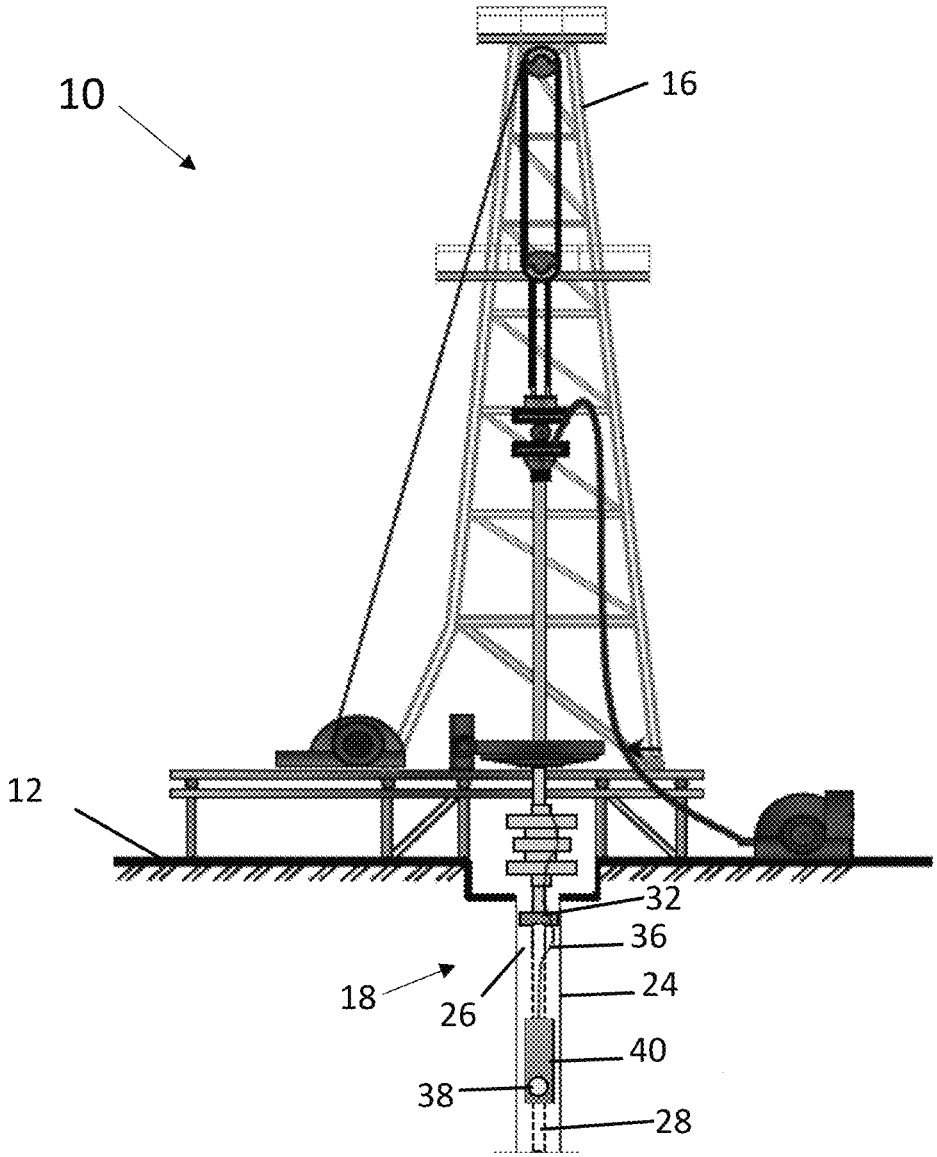
FIG. 2 illustrates a side view of an oil rig including a perforation system, according to aspects of the present embodiments.

FIG. 2 illustrates a side view of the oil rig 10, including a well perforating system that uses electrical discharge machining (EDM), according to aspects of the present disclosed embodiments. The oil rig 10 may include the derrick 16, the managed pressure drilling (MPD) system 32, the drill pipe 28, and the annulus 26. In the embodiment of FIG. 2, the oil rig 10 may include a perforation tool 40 disposed within the annulus 26 defined between the drill pipe 28 and the casing 24. The perforation tool 40 may be adjacent to (that is, rather than concentric about) the drill pipe 28. The perforation tool 40 may include at least one perforating head 38 disposed at one end of the perforation tool 40, as well as a wireline 36 that may electrically and/or operatively couple the perforating tool 40 to one or more respective power sources and/or control systems located at the surface 12, within the borehole 18, or at a remote location. The perforation tool 40, as illustrated in FIG. 2, may not necessarily be geometrically to scale relative to other components such as the borehole 18 and the drill pipe 28. In operation, an electrical charge at a first voltage is supplied to the perforation tool 40 and one or more sparks are created when the electrical charge discharges to a target location in the casing 24, via the perforating head 38. Stated otherwise, because the casing 24 is grounded (due to the casing 24 being in direct contact with the surrounding cement and formation), a spark may arc from the electrically charged perforating head 38 to the grounded casing 24, through fluids in the borehole 18, which may act as dielectric fluids.

Figure 3:
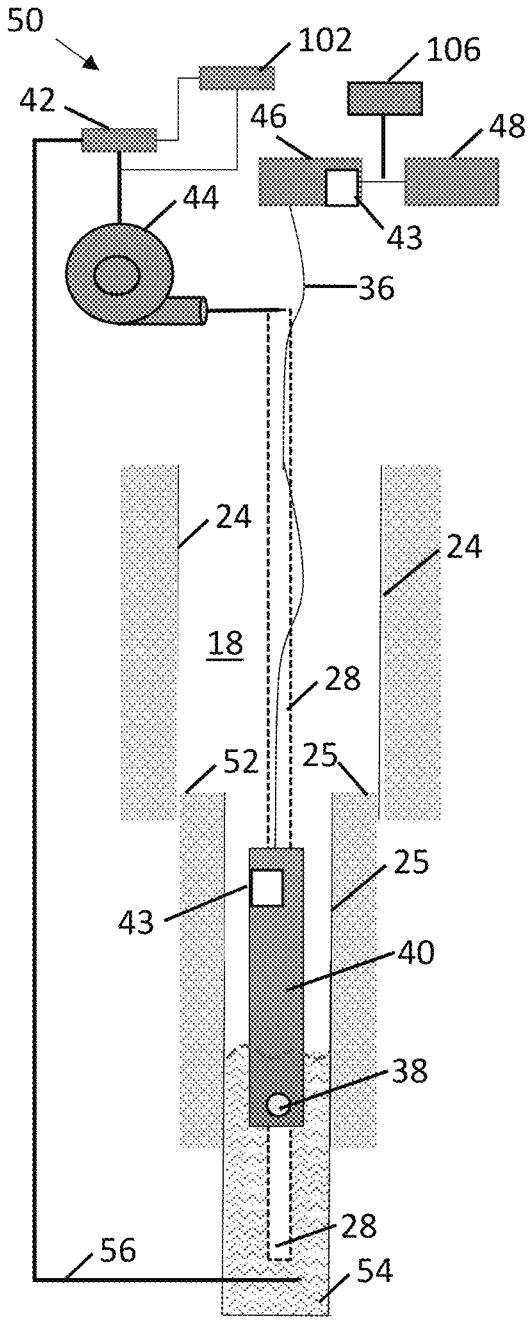
FIG. 3 illustrates a side view of a perforation system, according to aspects of the present embodiments.

FIG. 3 illustrates a side view of a perforation system 50, according to aspects of the present disclosed embodiments. The perforation system 50 may include a perforation tool 40 including a perforating head 38. At least one electrode (not shown) may be integrated into the perforating head 38 for discharging a spark into the target perforation location. The electrode may be electrically coupled to the wireline 36, which may be coupled to a pulse generator 46 disposed at the surface 12 or within the borehole 18. The wireline 36 may be disposed through a rotating control device (RCD) (not shown) and/or a managed pressure drilling (MPD) system 32 (shown in FIG. 2), disposed at or near the top of the borehole 18. The pulse generator 46 may be used to selectively generate electrical pulses at various frequencies, voltages, and currents, in order to create the desired spark characteristics at the perforating head 38 (for example, based on the dielectric fluid and the spark gap (that is, the space or gap between the perforating head 38 and the target perforation location)). The pulse generator 46 may be electrically coupled to one or more power supplies 48 located at the surface wellhead, and/or in the downhole environment.

Still referring to FIG. 3, the drill pipe 28 may be fluidly coupled to at least one pump 44 disposed at the surface and/or disposed within the borehole 18 (for example, an electrical submersible pump (ESP)). In the embodiment of FIG. 3, the drill pipe 28 may be located behind (that is, rather than through) the perforating tool 40. The pump 44 may be used to pump fluids through the drill pipe 28 to the bottom of the borehole 18. The pump 44 may also be used to clear spalled material and other debris from the perforation process away from the perforation site. As such, the perforating head 38 may be submerged in one or more dielectric fluids 54 occupying a bottom portion of the borehole 18. A return line 56 may be used to route the fluids back to the pump 44, after first passing through a filter 42, disposed upstream of the pump. One or more fluid tanks 102 may be fluidly connected directly to the pump 44 or alternatively indirectly coupled to the pump 44 via a filter 42. The filter 42 may be disposed directly upstream of the pump 44 to help remove debris, drill fragments, formation scraps, and other items from the fluid stream prior to the fluid entering the pump 44. The borehole 18 may include a top portion defined by the casing 24 or borehole walls, as well as a lower portion including a smaller diameter than the upper portion, the lower portion being defined by a cylindrical lower casing 25. One or more perorating platforms 52 may define a transition between the upper and lower portions of the borehole 18 and may include an annular planar surface that is substantially parallel to the radial plane (that is, the set of points that define a plane that is perpendicular to the longitudinal direction). The perforating platform(s) 52 may be used to vertically support the perforating tool 40 within the borehole 18, and may also be used to fix the perforating tool 40 at the desired location relative to the target perforating location or locations. During the perforation process, perforating platform(s) 52 may be deployed downhole by a cable, wirelines 36, or slickline (in wells that include vertical walls) or via coil tubing (in horizontal wells and/or horizontal tunnels), and then may be subsequently removed from the borehole 18 after the perforating operations have concluded. In each embodiment (vertical well, or horizontal well), the planar surface of each perforating platform 52 may be deployed at a 90-degree angle, or perpendicular to the longitudinal centerline of each tunnel, borehole, 18 or wellbore, thereby allowing the perforating head 38 to be oriented at a 90-degree angle with the perforation target in the casing 24.

Still referring to FIG. 3, the diameter of each perforation may be anywhere from about 1 mm in diameter to about 5 inches in diameter, including from about 0.5 inches in diameter to about 3 inches in diameter, or from about 0.8 inches in diameter to about 2.5 inches in diameter, or from about 1 inch in diameter to about 2 inches in diameter. The location of each perforation target area may be determined based on well logs, which help to identify the areas or regions of the formation that include high oil or hydrocarbon content, while also identify areas to avoid such as zones or regions that are indicated in the logs as including high water saturation levels.

Referring still to FIG. 3, in operation, the relative permittivity (that is, the dielectric constant) of the dielectric fluid 54 may change based on a number of factors including: the composition of drilling fluid that is used, the ratio of water to drilling fluid in the borehole 18, the salinity of the formation (for example, sandstone or carbonate), the presence of brine in the borehole 18, the use of a dedicated dielectric fluid 54, as well as other factors. As such, in some embodiments, a dedicated dielectric fluid 54 may be discharged from the tank 102 and pumped via the pump 44 into the borehole 18, in order to change the relative permittivity (or dielectric constant) of the fluid 54 in the borehole 18 while perforating operations are taking place. For example, water, purified water, salt water, mineral oil (such as transformer oil), hydrochloric acid, oil, diesel, crude oil, hydrofluoric acid, and other fluids may be used as a dielectric fluid 54. In some embodiments and implementations according to the present disclosure, hydrocarbons from the formation may mix with water and other drilling fluids in the borehole 18, thereby decreasing the relative permittivity of the dielectric fluid 54. The dielectric fluid may include a relative permittivity from about 1 to about 85, or from about 1.5 to about 83, or from about 2 to about 10, or from about 10 to about 75, or from about 20 to about 60, or from about 30 to about 50 or from about 35 to about 45.

Still referring to FIG. 3, the pulse generator 46 may emit pulses about once every 70 ns to about once every 140 ns (corresponding to an operating frequency from about 7.143 MHz to about 14.285 MHz) for low discharge energy perforating operations. The pulse generator 46 may emit pulses about once every 800 ns (nanosecond) to about once every 900 ns (corresponding to an operating frequency from about 1.11 MHz to about 1.25 MHz) for intermediate discharge energy perforating operations. Similarly, the pulse generator 46 may emit pulses about once every 2200 ns to about once every 5000 ns (corresponding to an operating frequency from about 200 kHz to about 454 kHz) for high discharge energy perforating operations. As such, the pulse generator may emit pulses within a total range from about once every 70 ns to about once every 5000 ns (corresponding to a total operating frequency range from about 200 kHz to about 15 MHz). In other embodiments, the pulse generator 46 may generate square waveform pulses lasting from about 1 millisecond (ms) to about 3000 ms, or from about 2 ms to about 2000 ms, or from about 5 ms to about 1000 ms, or from about 10 ms to about 500 ms, or from about 20 ms, to about 100 ms, or from about 35 ms to about 65 ms. Depending on the dielectric constant (or relative permittivity) of the dielectric fluid 54 in the borehole 18, the pulse generator 46 may operate in both a low voltage mode, as well as a high voltage mode and/or an intermediate voltage mode. In a low voltage mode, the pulse generator 46 may produce pulses from about 5 to about 400 volts, or from about 30 to about 350 volts, or from about 40 to about 300 volts, or from about 80 to about 200 volts, or from about 100 to about 160 volts. In a high voltage mode of operation, the pulse generator 46 may produce pulses from about 300 and to about 600 volts, or from about 350 to about 550 volts, or from about 400 to about 500 volts. In one or more embodiments, the high voltage mode of operation may include a voltage range that is higher than, and non-overlapping with the voltage range associated with the low voltage mode of operation. In other embodiments, the voltage ranges associate with the high voltage mode of operation and the low voltage mode of operation may overlap.

Referring still to FIG. 3, the perforation system 50 may include one or more control systems 106 operatively coupled to both the pulse generator 46 and the perforating tool 40 via the wireline 36. The control system 106 may also be electrically coupled to the power supply 48. The pulse generator 46 may operate at a current range from about 0.1 amps (A) to about 1000 A, or from about 0.5 A to about 500 A, or from about 2 A to about 100 A, or from about 15 A to about 90 A. The perforating tool 40 may be operated using a spark gap (that is, the distance from the perforating head 38 to the target location on the casing 24, 25) from about 0.001 millimeters (mm) to about 10 mm, or from about 0.005 mm to about 5 mm, or from about 0.01 mm to about 1 mm, or from about 0.05 mm to about 0.5 mm, or from about 0.15 to about 0.4 mm, or from about 0.25 to about 0.35 mm. In other embodiments, depending on the relative permittivity of the dielectric fluid 54, the spark gap may be from about 0.5 mm to about 50 mm, as well as various sub-ranges therebetween. The perforating system 50 may also include one or more voltage multipliers 43 disposed in the main body 39 of the perforating tool 40 and/or in the pulse generator 46, to account for various power losses throughout the system. The perforating system 50 may also include one or more telemetry cables (not shown) for helping to convey power and communications lines into the downhole environment. The perforating tool may be composed of any suitable material that is capable of withstanding downhole conditions (temperature, pressure, fluid bombardment, and corrosion exposure) including (but not limited to) corrosion resistance alloys (CRA), composite and non-metallic materials such as Polyether Ether Ketone (PEEK), carbon fiber reinforced non-metallic materials, fiber glass reinforced materials, basalt fiber reinforced materials, as well as other suitable materials.

Figure 4:
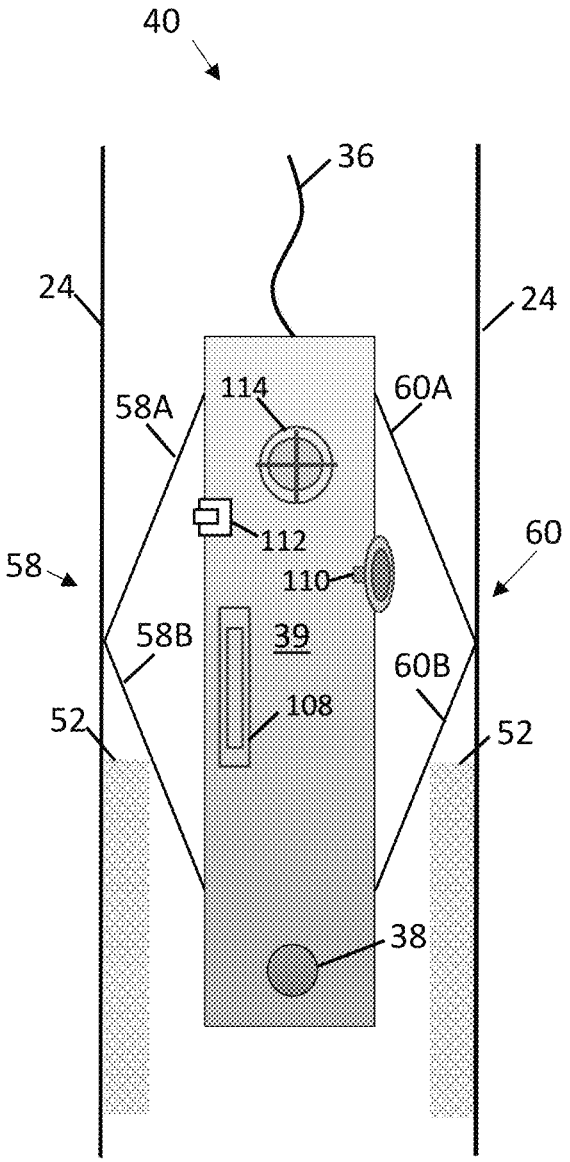
FIG. 4 illustrates a side view of a perforating tool, according to aspects of the present embodiments.

FIG. 4 illustrates a side view of the perforating tool 40, according to aspects of the present disclosed embodiments. The perforating tool 40 may include the wireline 36 and perforating head 38, and may be disposed within (that is, radially inward of) the casing 24. In the embodiment of FIG. 4, the perforating tool 40 may include a first set of arms 58 and a second set of arms 60. Each of the first and second sets of arms 58, 60 may include a first arm 58A, 60A and a second arm 58B, 60B. Each of the first arms 58A, 60A and the second arms 58B, 60B, may be coupled to both the main body 39 of the perforating tool 40, as well as to each other (that is, first arm 58A is coupled to (or linked to) second arm 58B, and first arm 60A is coupled to second arm 60B. The arms 58A, 58B, 60A, 60B may be rotatably coupled to each other such that the angle between each set of arms 58, 60 may be adjusted. Similarly, the arms 58A, 58B, 60A, 60B may be slidably coupled to the main body 39 such that an intersection point between each set of arms moves radially closer to and farther away from the main body 39 as the opposite end of each arm moves longitudinally up and down the main body 39. As such, each of the four (or more) arms 58A, 58B, 60A, 60B may be slidably coupled to the main body 39 at one end and rotatably coupled to an adjacent arm at the other end. The arms 58A, 58B, 60A, 60B may be slid in and out via electrical motors, linkages, servo motors, pistons, pneumatic cylinders, springs, internal actuating linkages, and other suitable mechanisms. By actuating the first and second sets of arms 58, 60 in and out, the perforating tool 40 may be placed at a desired location in proximity to the target location, and anchored to both the casing 24 and the perforating platform 52 via the arms 58A, 58B, 60A, 60B. In addition, because the first and second sets of arms 58, 60 are retractable, the overall diameter of the perforating tool 40 may be decreased while the perforating tool 40 is in the process of being deployed within the borehole 18, and/or through other components like the rotating control device (RCD), electrical submersible pumps (ESPs), pressure control devices (PCD), and the managed pressure drilling (MPD) system 32. Therefore, when not being actively used, the sets of arms 58, 60, 62, 64, may be retracted, thereby making the perforating tool 40 slimmer.

Referring still to FIG. 4, the perforating tool 40 may include one or more sensors including (but not limited to) a longitudinal vertical displacement transducer (LVDT) 108, a casing collar locator (CCL) 110, one or more anchoring sensors such as a proximity probe 112, and a gyroscope 114. The LVDT 108 may be used to assess whether or not the perforating tool 40 (for example, the perforating head 38) has penetrated the casing 24, and if it has, how far it has penetrated the casing 24. The LVDT 108 may also be used to assess how effective the perforating process has been, and may shed light on whether certain parameters such as the voltage, the dielectric fluid, and/or the spark gap 74 should be adjusted. The CCL 110 may be a magnetic sensor and may be used to measure the depth of the perforating head 38 within the dielectric fluid 54, which in turn will help in assessing if the perforating head 38 is positioned correctly. Other types of depth sensors may also be used. The proximity probe 112 may be used in connection with a feeler gauge or sensing arm to measure how close the perforating tool 40 is to the casing 24 (for example, to position the perforating tool 40 at the desired spark gap 74 (shown in FIG. 6)). The gyroscope 114 may be used to establish a frame of reference to ensure that the perforating tool 40 is oriented appropriately. Because the borehole 18 may be vertical, horizontal, diagonal, or even non-linear, it may not be possible to establish a frame of reference or orientation based on characteristics of the borehole 18 alone (for example, by relying on information from the proximity probe 112 detailing how close the perforating tool 40 is to the casing 24). As such, the gyroscope 114 may aid establishing the desired orientation of the perforating tool 40 in boreholes 18 with non-standard geometries. Each of the LVDT 108, the CCL 110, the proximity probe 112, and the gyroscope 114 may be communicatively coupled to the control system 106. In the embodiment of FIG. 4, the perforating head 38 may be disposed at or near the bottom of the main body 39 while the wireline 36 may be coupled to or near the top of the main body 39. Other embodiments according to the present disclosure may include other disposition locations for each of the perforating head 38 and wireline 36.

Figure 5:
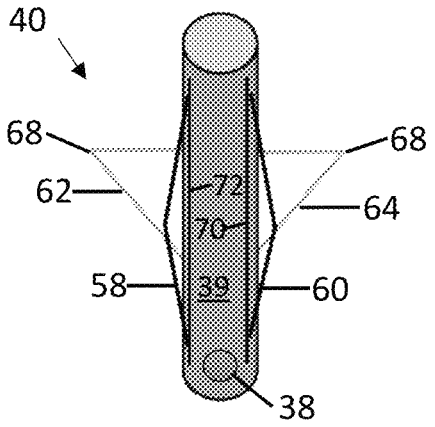
FIG. 5 illustrates a perspective view of a perforating tool, according to aspects of the present embodiments.

FIG. 5 illustrates a perspective view of the perforating tool 40, according to aspects of the present disclosed embodiments. The perforating tool 40 may include the perforating head 38, the first set of arms 58 and the second set of arms 60 (as well as the wireline 36, and other components). In the embodiment of FIG. 5, the perforating tool 40 may include a third set of arms 62 and a fourth set of arms 64. The first, second, third, and fourth sets of arms 58, 60, 62, 64 may be circumferentially spaced around the perforating tool 40 about ninety (90) degrees apart from each other. In other embodiments, the perforating tool 40 may include other numbers of arm sets include one (1), three (3), five (5), six (6) and more than six (6). In the embodiment of FIG. 5, the intersections 68 of the arms of each of the third and fourth sets of arms 62, 64 is at a smaller angle than each of the first and second sets of arms 58, 60, thereby resulting in the third and fourth sets of arms 62, 64 extending radially further away from the perforating tool main body 39 than each of the first and second sets of arms 58, 60. Conversely, the third and fourth sets of arms 62, 64 may be disposed at larger angles relative to the main body 39 when compared to the first and second sets of arms 58, 60, thereby resulting in the third and fourth sets of arms 62, 64 extending radially outwardly farther. The perforating tool 40 may include first and second arm guides 70, 72 (as well as third and fourth arm guides (not shown)) for allowing the first, second, third, and fourth sets of arms 58, 60, 62, 64 to slide therewithin relative to the main body 39.

Figure 6:
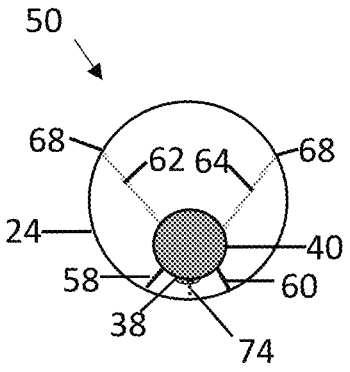
FIG. 6 illustrates a top view of a perforating tool, according to aspects of the present embodiments.

FIG. 6 illustrates a top view of the perforating system 50, according to aspects of the present disclosed embodiments. In the embodiment of FIG. 6, the perforating system 50 may include the perforating tool 40, and the borehole 18 in which it is deployed or installed, as well as other system components (such as those illustrated in FIG. 3). In the embodiment of FIG. 6, each of the third and fourth arms 62, 64 are radially outwardly extended further than each of the first and second arms 58, 60 thereby allowing the perforating head 38 to be brought closer to the casing 24 or target location. By selectively (and in some embodiments independently) adjusting the angles of each of the first, second, third, and fourth sets of arms 58, 60, 62, 64, the intersections 68 of each set of arms 58, 60, 62, 64 may anchor the perforating tool 40 against the casing 24 (and/or the perforating platform 52, shown in FIGS. 3 and 4) while also allowing the perforating head 38 to be located at a desired distance or spark gap 74 from the casing. The first, second, third, and fourth sets of anchoring arms 58, 60, 62, 64 may be composed of, or coated with, corrosion resistant alloys (CRA) in order to ensure a long part life. The corrosion resistant alloys may include for example nickel and chromium in order to provide resistance to high temperatures, as well as resistance to corrosive environments. The first, second, third, and fourth sets of anchoring arms 58, 60, 62, 64 may also be composed of stainless steel, carbon steel, austenitic steel, galvanized stainless steel, and other suitable materials.

Figure 7:
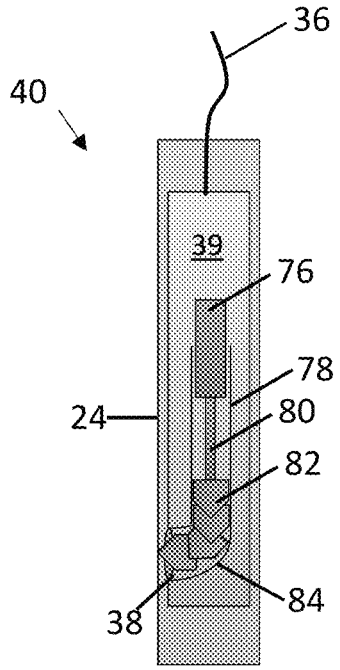
FIG. 7 illustrates a side view of a perforating tool, according to aspects of the present embodiments.

FIG. 7 illustrates a side view of the perforating tool 40, according to aspects of the present disclosed embodiments. In the embodiment of FIG. 7, the perforating tool 40 includes a hydraulic piston system to deploy the perforating head 40 at various radii as the perforating operations are occurring. The hydraulic piston system of FIG. 7 may be used in connection with each of the embodiments illustrated in FIGS. 2-6 (for example, to move the perforating head 38 in and out during perforating operations). The hydraulic piston system may include a piston head 76 mechanically coupled via a tie rod 80 to a plurality of nested caps 84, each of the piston head 76 and tie rod 80 being disposed within a piston cylinder 78. Each of the nested caps 84 is at least partially rotatably coupled to an adjacent nested cap 84, thereby allowing the plurality of linked nested caps 84 to maneuver back and forth within a contoured portion 84 that transforms longitudinal motion (that is, axial motion) to radial motion. The final nested cap 84 is coupled to the perforating head 38, thereby allowing the perforating head to move radially in and out of the perforating tool main body 39 such that it may penetrate into the casing 24 (as well as into and through the cement and formation behind the casing 24), as needed during perforating activities. The hydraulic piston system may be actuated via pressure differentials. One or more fluid tubes (not shown) may fluidly connect to the piston head 76 such that as pressure builds up upstream of the piston head, the piston head moves longitudinally downward. The system may be driven by an internal electric compressor or motor. Alternatively, an electric motor may be used to directly move and/or actuate the piston head 76. The piston head 76 and perforating head 38 may then be passively retracted as the pressure pushing on the perforating head 38 exceeds an internal pressure acting on the piston head 76 via the fluid tube upstream of the piston head 76. Power may be conveyed to the system via the wireline 36, which may be electrically coupled directly to both the piston hydraulic system and the perforating head 38.

Figure 8:
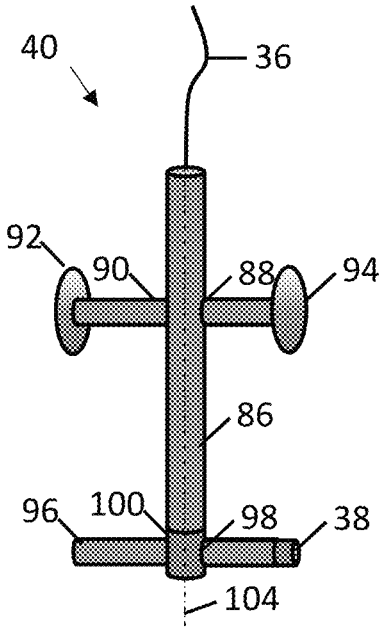
FIG. 8 illustrates a side view of a perforating tool, according to aspects of the present embodiments.

FIG. 8 illustrates a perspective side view of the perforating tool 40, according to aspects of the present embodiments. The embodiment of FIG. 8 includes an alternate configuration of the perforating tool 40 than the configurations of each of FIGS. 3-7. In the embodiment of FIG. 8, the perforating tool 40 may include a longitudinal body 86 that includes a generally cylindrical form and may be concentrically disposed about a centerline 104. The wireline 36 may attach to the perforating tool 40 at the top of the longitudinal body 86. The perforating tool 40 may include one or more lateral anchoring arms 90 perpendicular to, and disposed through, the longitudinal body 86. A first anchoring pad 92 may be disposed at a first end of the lateral anchoring arm 90 while a second anchoring pad 94 may be disposed at a second end of the lateral anchoring arm 90. The lateral anchoring arm 90 may slide through a hole 88 disposed within the longitudinal body 86, thereby allowing the pads to contact the casing 24 and anchor the perforating tool 40 in a desired position. The one or more lateral anchoring arms 90 may include multiple segments that telescope within each other, thereby allowing the lateral anchoring arms 90 to extend to multiple radii, as desired.

Referring still to FIG. 8, the perforating tool 40 may include a perforating rod 96 with a perforating head 38 disposed at one end. The perforating rod 96 may be coupled to the longitudinal body 86 via one or more rotary couplings 100, thereby allowing the perforating rod 96 to rotate about the center line 104 such that the perforating head 38 may be positioned at a desired spark gap 70 from the target location. The perforating rod 96 may also slide through a second hole 98 disposed within the rotary coupling 100, allowing the perforating rod 96 and perforating head 38 to be selectively extended and retracted. Each of the perforating rod 96, the rotary coupling 100, and the lateral anchoring arm 90 may be articulated via electrical motors, linkages, servo motors, pistons, pneumatic cylinders, springs, internal actuating linkages, and other suitable mechanisms. The wireline 36 may also be electrically coupled to the perforating head 38, thereby allowing sparks to be generated between the perforating head 38 and the target location, as a result of the electrical pulses from the pulse generator 46 (shown in FIG. 3). In each of the embodiments of FIGS. 2-8, the thickness of the casing 24 may range from less than half of an inch to about 2.5 or three inches. As such, the total lateral or radial travel range of the perforating range may be from about zero (0) inches to about five (5) inches, ten (10) inches, or more inches such that the perforating head 38 may perforate through the full casing 24 thickness, the surrounding concrete, and even into the formation surrounding the concrete.

Figure 9:
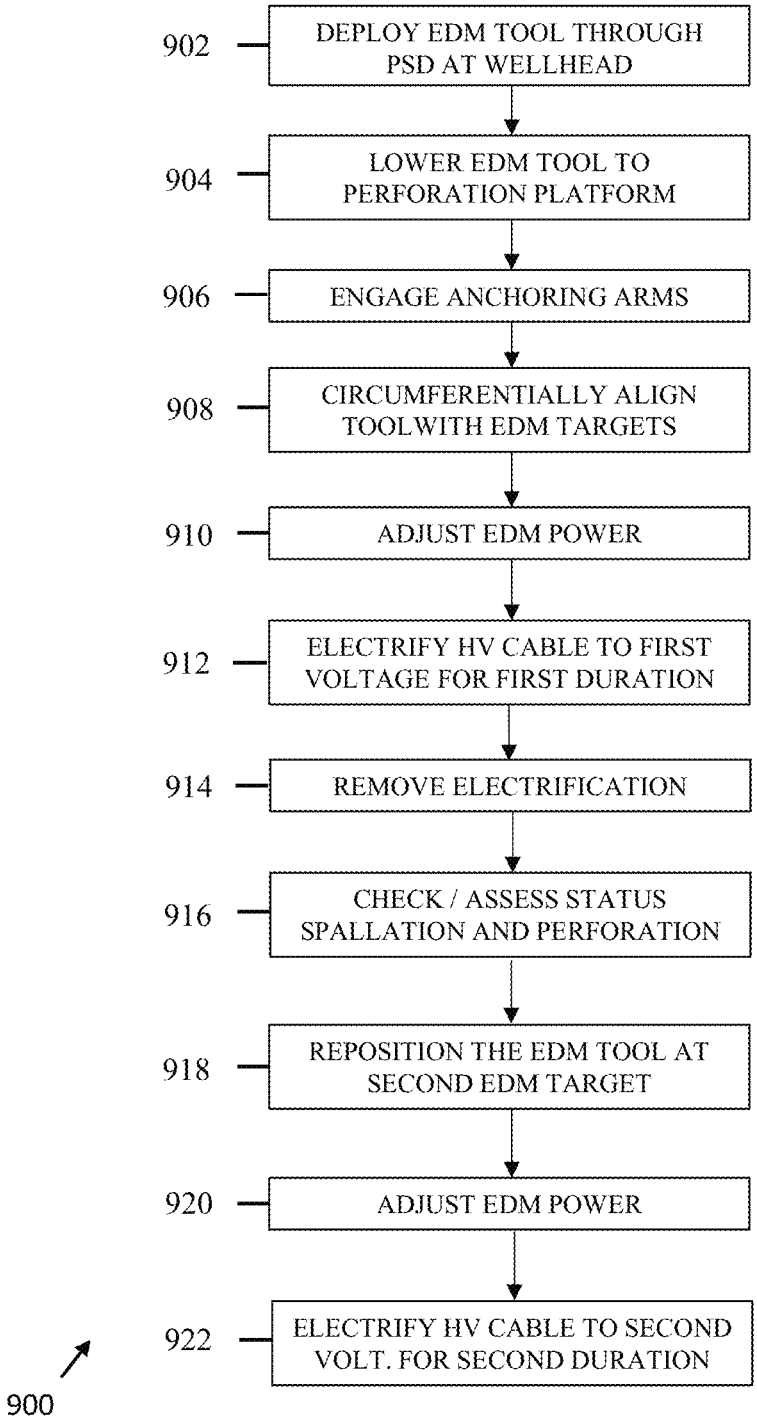
FIG. 9 illustrates a schematic of a method of perforating a well, according to aspects of the present embodiments.

FIG. 9 illustrates a method 900 of perforating a well or borehole, according to aspects of the present disclosed embodiments. At step 902, the method 900 may include deploying the electrical discharge machining (EDM) perforating tool 40 through a pressure seal device (PSD) at the wellhead. At step 904, the method 900 may include lowering the EDM perforating tool 40 to a perforating platform 52. The EDM perforating tool 40 may be lowered into the borehole 18 via wireline 36 or via coiled tubing and/or tractor for horizontal wells and tunnels, and/or highly deviated wells. At step 906, the method 900 may include engaging the first, second, third, and/or fourth sets of arms 58, 60, 62, 64 on the perforating platform 52. At step 908, the method 900 may include circumferentially aligning the tool with the EDM target locations (that is, the perforating sites). At step 908, the method 900 may also include engaging a third and/or fourth set of arms 62, 64 to circumferentially secure the perforating tool 40, once the desired circumferential alignment has been achieved. At step 910, the method 900 may include adjusting the EDM power at the pulse generator 46 (for example, the electrical current, the operating frequency, the pulse duration, the pulse wave form or shape, and/or the voltage). At step 912, the method 900 may include electrifying a high voltage cable (or wireline 36, or high voltage wireline 36) to a first voltage (and a first current, and a first operating frequency) for a first duration. At step 914, the method 900 may include removing or ceasing the electrification of the wireline 36. At step 916, the method 900 may include checking and/or assessing the status of the spallation and/or the perforation. At step 918, the method 900 may include repositioning the EDM perforating tool 900 at a second EDM target location (or perforation site). At step 920, the method 900 may include adjusting the EDM power (for example, the voltage, frequency, pulse duration, current, and waveform). At step 922, the method 900 may include electrifying the high voltage cable (or wireline 36, or high voltage wireline 36) to a second voltage (and a second current, and a second operating frequency) for a second duration.

In each of the embodiments disclosed herein, the perforating tool 40 may include a number of perforating heads 38 (each with a dedicated electrode) including, for example, a single perforating head 38, two (2) perforating heads 38 circumferentially spaced about one-hundred and eighty (180) degrees apart, three (3) perforating heads 38 circumferentially spaced about one-hundred and twenty (120) degrees apart, four (4) perforating heads 38 circumferentially spaced about ninety (90) degrees apart, six (6) perforating heads 38 circumferentially spaced about sixty (60) degrees apart, as well as more than six (6) perforating heads 38. In some embodiments, the perforating tool 40 may include multiple perforating heads 40 that are longitudinally (or axially) spaced from each other. The perforating tool 40 and components thereof (for example, the perforating head 38 and the main body 39) may be composed of a metallic material such as a soft metallic material such as graphite. The perforating tool 40 and components thereof (for example, the perforating head 38 and the main body 39) may be composed of corrosion resistant materials (CRA) to allow the perforating tool 40 to withstand the harsh conditions (pressure, temperature, fluid bombardment, and corrosion exposure) within the downhole environment.

In operation, the present disclosed perforating tool 40 and system 50 may be used in connection with a managed pressure drilling (MPD) system 32 in which the borehole 18 is pressurized and the oxygen has been evacuated from the borehole 18. As such, the risk of ignition of the dielectric fluid 54, even with hydrocarbons present, is very low. The wireline 36 may include one or more high gauge wires such that it may accommodate higher voltages. For example, the wireline 36 may include one or more high gauge wires that is from about four (4) gauge to about thirty (30) gauge, or from about six (6) gauge to about twenty-four (24) gauge, or from about eight (8) gauge to about twenty (20) gauge, or from about ten (10) gauge to about eighteen (18) gauge, or from about twelve (12) gauge to about sixteen (16) gauge, or about fourteen (14) gauge. The wireline 36 may be protected from fluids and grounding via an insulating shield. The wireline 36 may also include one or more coaxial cables. In applications that employ coil tubing, the coil may act as protection for the wireline 36 and/or high-voltage cable as well. Perforations made via the present disclosed embodiments, systems, and methods may take longer to make than perforations made using perforating guns (that is, the duration it takes the perforation to be made). However, the present disclosed embodiments, systems, and methods allow perforations to be made without perforating guns, thereby eliminating formalities and requirements associated with site safety (for example, environmental health and safety (EHS)) as well as eliminating public safety concerns associated with perforating guns. As such, the overall time, preparation, and coordination required to perforate a well using the perforating tool 40 and perforation system 50 of the present disclosed embodiments may all be significantly reduced as compared to methods and systems of perforating a well via perforating guns.

The perforating tool 40 and perforating system 50 of the present disclosed embodiments may be used to perforate the casing 24, cement, and formation during any phase of a well life including newly formed wells, wells that are in the process of being constructed, older wells, operating wells (that is, live wells), wells that are out of service, and wells that are undergoing maintenance and/or repairs. As hydrocarbon-producing wells begin to produce water above an economic limit (for example, net production begins to drop due to an increasing ratio of water to hydrocarbons present), perforations that yield water may be plugged while new perforations in the hydrocarbon-bearing zones may be added. The perforating tool 40 of the present disclosed embodiments may include an overall diameter of about two (2) inches, or from about one (1) inch to about three (3) inches, or from about three quarters (0.75) of an inch to about five (5) inches, as well as other dimensions. In some embodiments, the perforating tool 40 may include a diameter of no greater than four (4) inches such that it may fit through commonly used production tubing that includes an inner diameter of about four and a half (4.5) inches. The sets of anchoring arms 58, 60, 62, 64 may be expandable well beyond about four and a half (4.5) inches when they are deployed, even if, when retracted, they remain within the about four (4) inch outer diameter of the perforating tool 40. In some embodiments, the overall longitudinal length of the perforating tool 40 may be less than or equal to about ten

(10) feet so that it may fit through the most common types of lubricators. For example, in some embodiments according to the present disclosure, the perforating tool 40 may include a longitudinal length from about three (3) feet to about ten (10) feet, or from about four (4) feet to about nine (9) feet, or from about five (5) feet to about eight (8) feet, or from about six (6) to about seven (7) feet, or from about six (6) to about nine (9) feet, or from about seven (7) to about ten (10) feet.

The perforating tool 40 and perforating system 50 of the present disclosed embodiments may be activated and controlled by an operator at the surface, in connection with the wireline 36, control system 106, power supply 48, voltage multiplier 43, and pulse generator 46. The operator may use the sensors 108, 110, 112, 114 to locate the perforating tool 40 within the borehole 18 at the desired depth and circumferential location such that the perforating head 38 is aligned with the target location(s). In addition, the operator may use the sensors 108, 110, 112, 114 to locate the perforating tool 40 at the desired longitudinal orientation such that the perforating head 38 is oriented to ensure the maximum horizontal stresses within the casing 24, cement, or formation (that is, oriented normal or perpendicular to the casing 24), as it applies to vertical wells, as well as other well applications such as horizontal wells, tunnels, diagonal wells, and non-linear wells. Proper alignment and positioning of the perforating tool 40 will enable fracturing of the well with the least possible required pressure and/or facture tortuosity.

The perforating tool 40 and perforating system 50 of the present disclosed embodiments may include an orientation sub-assembly disposed in the main body 39 and including the sensors (for example, the longitudinal vertical displacement transducer (LVDT) 108, the casing collar locator (CCL) 110, the proximity probe 112, the gyroscope 114, as well as other potential sensors) to ensure the perforating tool 40 and perforating head 38 are located, oriented, and aligned properly. As the electrode within the perforating head 38 is activated (that is, electrified at the operational voltage levels), one or more sparks will naturally arc to the nearest ground location, which will occur at the perforation target location on the casing 24, cement, or formation. Plasma within the dielectric fluid 54 will form as a result of increased temperature resulting from the spark. The plasma will in turn cause a spalling effect at the target location, causing erosion and spallation, thereby forming a perforation. In one or more embodiments, a fluid pathway may be disposed within the main body 39 of the perforating tool 40 that allows dielectric fluid 54 to be dispersed from (or near) the perforating head 38 toward the target location, thereby helping to ensure consistent fluid properties of the dielectric fluid 54 during perforating operations, while also helping to clean, flush, and purge the perforation target location of excess material and debris that result from the spallation and erosion of the target location, (that is, while the perforation process is occurring). The perforating tool 40 and perforating system 50 of the present disclosed embodiments allow perforations to be made in downhole environments in live-well deployments (that is, via standard lubricators) without the need for perforating guns. In addition, wirelines 36 and other standard equipment such as slicklines, power supplies 48, and sensors 108, 110, 112, 114 may be used to provide the required operational conditions and process parameters for electrical discharge machining (EDM) in the downhole environment. The retractable sets of anchoring arms 58, 60, 62, 64 also allow for deployment of the perforating tool 40 of the present disclosed embodiments through standard tubing, without requiring any equipment, borehole 18, or site modifications.

Elements of different implementations described may be combined to form other implementations not specifically set forth previously. Elements may be left out of the processes described without adversely affecting their operation or the operation of the system in general. Furthermore, various separate elements may be combined into one or more individual elements to perform the functions described in this specification.

Other implementations not specifically described in this specification are also within the scope of the following claims.

These and other features, aspects and advantages of the present invention will become better understood with reference to the following description and appended claims. The accompanying drawings, which are incorporated in and constitute a part of this specification, illustrate embodiments of the present disclosure and, together with the description, serve to explain the principles of the present embodiments.

Certain Definitions

In order for the present disclosure to be more readily understood, certain terms are first defined below. Additional definitions for the following terms and other terms are set forth throughout the specification.

An apparatus, system, or method described herein as "comprising" one or more named elements or steps is open-ended, meaning that the named elements or steps are essential, but other elements or steps may be added within the scope of the apparatus, system, or method. To avoid prolixity, it is also understood that any apparatus, system, or method described as "comprising" (or which "comprises") one or more named elements or steps also describes the corresponding, more limited apparatus system, or method "consisting essentially of" (or which "consists essentially of") the same named elements or steps, meaning that the apparatus, system, or method includes the named essential elements or steps and may also include additional elements or steps that do not materially affect the basic and novel characteristic(s) of the system, apparatus, or method. It is also understood that any apparatus, system, or method described herein as "comprising" or "consisting essentially of" one or more named elements or steps also describes the corresponding, more limited, and closed-ended apparatus, system, or method "consisting of" (or "consists of") the named elements or steps to the exclusion of any other unnamed element or step. In any apparatus, system, or method disclosed herein, known or disclosed equivalents of any named essential element or step may be substituted for that element or step.

As used herein, the term "longitudinally" generally refers to the vertical direction, and may also refer to directions that are co-linear with or parallel to the centerlines 104 of the perforating tool 40, drill pipe 28, and/or borehole 18. Angles that are defined relative to a longitudinal direction may include both negative and positive angles. For example, a 30-degree angle relative to the longitudinal direction may include both an angle that is rotated clockwise 30 degrees from the vertical direction (that is, a positive 30-degree angle) as well as an angle that is rotated counterclockwise 30 degrees from the vertical direction (that is, a negative 30-degree angle).

As used herein, "a" or "an" with reference to a claim feature means "one or more," or "at least one."

As used herein, the term "substantially" refers to the qualitative condition of exhibiting total or near-total extent or degree of a characteristic or property of interest.

EQUIVALENTS

It is to be understood that while the disclosure has been described in conjunction with the detailed description thereof, the foregoing description is intended to illustrate and not limit the scope of the invention(s). Other aspects, advantages, and modifications are within the scope of the claims.

This written description uses examples to disclose the invention, including the best mode, and also to enable any person skilled in the art to practice the present embodiments, including making and using any devices or systems and performing any incorporated methods. The patentable scope of the present embodiments is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A perforation system comprising:

a perforating tool comprising a main body and a perforating head disposed within the main body;

a wireline electrically coupled to the perforating head;

a pulse generator electrically coupled to the wireline; and a power supply electrically coupled to the pulse generator, a hydraulic piston disposed within the main body, the hydraulic piston comprising:

a piston cylinder; and a piston head mechanically coupled to a plurality of nested caps via at least one tie rod, where each of the piston head and the at least one tie rod are disposed within the piston cylinder, where, upon electrification of the perforating head, a spark discharged from the perforating head arcs to a perforation target location, and where the hydraulic piston pushes the perforating head radially outward as the perforation target location begins to spall.

2. The system of claim 1, where the electrification occurs at a voltage in a range from 30 volts to 600 volts.

3. The system of claim 1, where the electrification occurs at an operating frequency from 200 kHz to 15 MHz.

4. The system of claim 1, further comprising a dielectric fluid disposed between the perforating head and the perforation target location, the dielectric fluid comprising at least one of water, purified water, salt water, mineral oil, transformer oil, hydrochloric acid, oil, diesel, crude oil, and hydrofluoric acid, where the resulting perforation comprises a diameter from 1 mm to 5 inches.

5. The system of claim 1, further comprising a voltage multiplier disposed in at least one of the main body and the pulse generator, where the main body comprises as least one of a corrosion resistant alloy (CRA), polyether ether ketone (PEEK), carbon fiber reinforced non-metallic materials, fiber glass reinforced materials, and basalt fiber reinforced materials.

6. The system of claim 1, where a duration of each pulse transmitted by the pulse generator to the perforating head is from 1 millisecond (ms) to 3000 ms.

7. The system of claim 1, further comprising a dielectric fluid disposed between the perforating head and the perforation target location, the dielectric fluid comprising at least one of water, purified water, salt water, mineral oil, transformer oil, hydrochloric acid, oil, diesel, crude oil, and hydrofluoric acid, where the electrification occurs at a voltage in a range from 30 volts to 600 volts, and where the electrification occurs at an operating frequency from 200 kHz to 15 MHz.

8. The system of claim 1, comprising at least one sensor disposed on or within the main body, the at least one sensor comprising: a longitudinal vertical displacement transducer (LVDT), a casing collar locator (CCL), a proximity probe, and a gyroscope.

9. The system of claim 1, further comprising a dielectric fluid disposed between the perforating head and a perforation target location, where the dielectric fluid comprises a relative permittivity in a range from 1 to 85.

10. The system of claim 1, where each of the plurality of nested caps is at least partially rotatably coupled to an adjacent nested cap of the plurality of nested caps, thereby allowing the plurality of nested caps to maneuver back and forth within a contoured portion of the piston cylinder that transforms axial motion to radial motion.

11. A perforation tool comprising:

a main body comprising a generally cylindrical shape;

a perforating head disposed within the main body proximate a bottom end of the main body, the perforating head comprising at least one electrode;

a wireline electrically coupled to the perforating head, the wireline coupled to a top end of the main body; and two or more sets of anchoring arms, each set of the two or more sets of anchoring arms longitudinally disposed along an outer surface of the main body, the two or more sets of anchoring arms further comprising:

a first set of arms;

a second set of arms;

a third set of arms; and a fourth set of arms, where each of the two or more sets of anchoring arms may selectively expand and retract radially outward and inward to position and anchor the main body proximate a perforation target location, where each set of the two or more sets of anchoring arms comprises at least two arms rotatably coupled at one end to each other, where at least one arm of the at least two arms is slidably coupled at the other end to the main body, and where each of the third set of arms and the fourth set of arms radially outwardly extends further than each of the first set of arms and the second set of arms, thereby allowing the perforating head to be brought closer to the perforating target location.

12. The tool of claim 11, comprising at least one sensor disposed on or within the main body, the at least one sensor comprising at least one of a longitudinal vertical displacement transducer (LVDT), a proximity probe, and a gyroscope.

13. The tool of claim 11, where each set of the two or more sets of anchoring arms comprises a first arm and a second arm, where each of the first arm and second arm are coupled together at a first end, and where each of the first arm and second are arm are coupled to the main body at a second end.

14. A method of perforating a well comprising:

disposing a perforating tool downhole, the perforating tool comprising: a main body, a perforating head disposed within the main body, and at least one electrode disposed within the perforating head;

locating the perforating tool proximate a perforation target location disposed within the well; and electrifying the at least one electrode such that at least one spark arcs from the perforating head to the perforation target location, where the main body comprises at least one sensor disposed on or within the main body, the at least one sensor comprising: a longitudinal vertical displacement transducer (LVDT), a casing collar locator (CCL), a proximity probe, and a gyroscope.

15. The method of claim 14, further comprising radially expanding at least one set of anchoring arms after locating the perforating tool such that the at least one set of anchoring arms engages a casing of the well.

16. The method of claim 15, where the at least one set of anchoring arms engages a perforating platform disposed within the well, the perforating platform comprising a planar surface that is oriented perpendicular to a centerline of the well.

17. The method of claim 16, further comprising:

removing electrification from the perforating head; and assessing the status of the perforation target location.

18. The method of claim 14, where locating the perforating tool further comprises circumferentially aligning the perforating head with the perforating target location.

19. The method of claim 14, where locating the perforating tool proximate a perforation target location comprises locating the perforating tool at a distance in a range from 0.001 mm to 10 mm from the target location such that a desired spark gap is achieved.

* * * * *